US008413733B2

(12) United States Patent
Guo et al.

(10) Patent No.: US 8,413,733 B2
(45) Date of Patent: Apr. 9, 2013

(54) BI-DIRECTIONAL HORIZONTAL SPRAYING AEROSOL FIRE-EXTINGUISHING APPARATUS

(75) Inventors: Hongbao Guo, Gaoxin District Xi'an Shaanxi (CN); Zanfeng Zhang, Gaoxin District Xi'an Shaanxi (CN); Guoxing Zhang, Gaoxin District Xi'an Shaanxi (CN); Peng Xie, Gaoxin District Xi'an Shaanxi (CN)

(73) Assignee: Shaanxi J&R Fire Fighting Co., Ltd., Shaanxi (CN)

( * ) Notice: Subject to any disclaimer, the term of this patent is extended or adjusted under 35 U.S.C. 154(b) by 0 days.

(21) Appl. No.: 12/522,025

(22) PCT Filed: Nov. 15, 2007

(86) PCT No.: PCT/CN2007/003230

§ 371 (c)(1),
(2), (4) Date: Dec. 2, 2009

(87) PCT Pub. No.: WO2008/086680

PCT Pub. Date: Jul. 24, 2008

(65) Prior Publication Data

US 2010/0065285 A1 Mar. 18, 2010

(30) Foreign Application Priority Data

Jan. 5, 2007 (CN) ..... 2007 2 0031003 U

(51) Int. Cl.
*A62C 35/00* (2006.01)

(52) U.S. Cl. ..... 169/12; 169/11; 169/26; 169/28; 169/84

(58) Field of Classification Search ..... 169/9, 11, 169/12, 26, 28, 84
See application file for complete search history.

(56) References Cited

U.S. PATENT DOCUMENTS 5,992,528 A * 11/1999 Parkinson et al. ..... 169/84
6,116,348 A * 9/2000 Drakin ..... 169/12

FOREIGN PATENT DOCUMENTS

| | | | |
|---|---|---|---|
| CN | 2519680 | Y | 11/2002 |
| EP | 0569025 | A2 | 11/1993 |
| EP | 0976423 | B1 | 2/2000 |
| EP | 2143471 | B1 | 1/2010 |
| RU | 2118903 | | 9/1998 |
| WO | 00/03765 | | 1/2000 |

OTHER PUBLICATIONS

English Abstract of EP 0569025A2 Published Nov. 10, 1993.
English Abstract of CN 2519680Y Published Nov. 6, 2002.
English Abstract of EP0976423B1 Published Feb. 2, 2000.
Official Action in Application 07816836.6 Issued Feb. 2, 2012.
Official Action in Application 07 816 836.6 Issued Jun. 7, 2011.
Official Action in Application 07816836.6 Issued Dec. 28, 2009.

* cited by examiner

*Primary Examiner* — Steven J Ganey
(74) *Attorney, Agent, or Firm* — Ladas & Parry LLP

(57) ABSTRACT

A new bi-directional horizontal spraying aerosol fire-extinguishing apparatus is disclosed, which comprises a shell structure, an aerosol generator including an aerosol generating agent and disposed inside the shell structure, and a control unit for initiating the aerosol generator. The bi-directional horizontal spraying aerosol fire-extinguishing apparatus of the present invention is characterized in that both ends of the shell structure or of the aerosol generator are respectively provided with an aerosol exhaust passage. The advantages of the present apparatus are in that it can reduce the spraying time of the aerosol extinguishing agent in the case of ensuring the fire-suppression efficiency, and increase the charge capacity of the fire-extinguishing apparatus, so that the capacity efficiency of the present apparatus is totally increased, and the present apparatus is easy and safe to be installed and does not occupy the useful space.

3 Claims, 1 Drawing Sheet

BI-DIRECTIONAL HORIZONTAL SPRAYING AEROSOL FIRE-EXTINGUISHING APPARATUS

TECHNICAL FIELD OF THE INVENTION

This invention relates to a fire-extinguishing apparatus, specifically, a new bi-directional horizontal spraying aerosol fire-extinguishing apparatus.

BACKGROUND OF THE INVENTION

Since the enforcement of the "Montreal Protocol on Substances that Deplete the Ozone Layer", which was signed in 1987 as the result of concerns of the international community on issues about ozone layer, Halon fire-extinguishing agent series, which account for more that ⅓ of the total amounts of ozone depleting chemicals used in fire-fighting industry, are gradually substituted by new kinds of fire-extinguishing products that are environment-friendly or relatively friendly. In recent years, the aerosol fire-extinguishing apparatus developed is a typical apparatus in the field of gas fire-extinguishing, this aerosol product is increasingly appreciated in fire-fighting industry and by research & development departments due to its advantages of no damage to ozone layer, no greenhouse effect entailed, no pollution to the environment, and superiority over fire-fighting apparatuses with gases such as trifluoromethane, heptafluoropropane and carbon dioxide and the like by producing innocuous substances which are harmless to people and have little damage to the object protected from fire, as well as high fire-suppression efficiency and so on. Particularly, the third generation aerosol fire-extinguishing apparatus, charged with aerosol generating agent including 35%-50% strontium nitrate and 10%-20% potassium nitrate, overcomes the defects that the insulation capability of the object to be protected from fire will decrease after applying the fire-extinguishing agent contained in the second generation aerosol fire-extinguishing apparatus charged with more than 30% potassium nitrate. Moreover, the third generation aerosol fire-extinguishing apparatus also has the advantages of non-corrosiveness, moisture-resistance and non-electric conduction. Therefore, it is becoming a popular concern in the industry of fire-fighting apparatus production, research and development all over the world.

In the prior art before the disclosure of the present invention, the efficiency of fire-suppression is the target pursued in the design of the fire-extinguishing apparatus in fire-extinguishing industry, which is improved mainly in terms of the design of the fire-extinguishing agent. Different fire-extinguishing agents have different fire-extinguishing mechanisms, resulting in different designs of fire-extinguishing apparatuses. The object of fire extinguishing can be achieved by eliminating or reducing any one or two of the following conditions necessary for combustion, i.e. (1) density of the combustible substance; (2) oxygen content; (3) ignition heat; (4) unrestrained chain reaction. At present, according to different installation manners, the present fire-extinguishing apparatuses can be mainly classified into two types, i.e. floor standing type and suspended type. Several kinds of fire-extinguishing apparatuses have been disclosed in published patent documents, which include patent ZL97248609.7, patent application 9912556.4 and patent ZL01277738.2 owned by Shanxi Anhua Extinguishing Apparatus Co. Ltd., patent ZL02262244.6 owned by Xi'an Xinzhu Fire & Rescue Equipment Limited Company, and patent application 200510082726.5 filed by Beijing Institute of Technology. Although the double-shell structure of the apparatus disclosed in ZL97248609.7 has some positive effect in reducing the temperature of the shell surface, it has the disadvantages of low space-effectiveness due to its huge and bulky body, and the designs described therein for heat-absorbing and fire-inhibiting are relatively simple. The apparatuses disclosed in patent application 9912556.4 and patent ZL01277738.2 both have shutter-type sprayers and are respectively provided with baffle plates, fire-retardant and temperature regulating rods and meshworks, and retardant blocks, which have positive effect on aerosol temperature reduction and uniform spray thereof, and, however, have no improvement in the combustion speed. The apparatus disclosed in patent ZL02262244.6 adopts a double-layer structure and is provided with a complete oxidation chamber and a metal meshwork, which only aims to solve the issues about cooling, filtration and outlet temperature of aerosol. The apparatus disclosed in the patent application 200510082726.5 uses the admixture of aerosol and dry-powder as fire-extinguishing agent, and has chemical and physical cooling chambers, which makes it possible to put out a fire by means of both aerosol and dry-powder. However, due to the addition of dry-powder, the fire-extinguishing apparatus can only be referred to as an apparatus designed for unclean fire-extinguishing agent.

In addition to the important factor such as the design of the fire-extinguishing agent, i.e. the composition of the fire-extinguishing agent, considering the structure design of the apparatus, the fire-suppression efficiency of the aerosol fire-extinguishing apparatus depends on several further factors, such as spraying time, temperature of the sprayer, process and condition of the spraying, and surface temperature of the fire-extinguishing apparatus. Wherein, the spraying time (which refers to, after the actuation of the fire-extinguishing apparatus, the time duration starting from the spray of aerosol fire-extinguishing agent from spray nozzle to the stop thereof, which according to the standard of GA499.1-2004, is no more than 120 s under the experimental temperature of 20° C.±5° C.) is the key factor affecting the fire-suppression efficiency of the apparatus. The above-mentioned various apparatuses of prior art are designed substantially according to the design solution of the fire-extinguishing agent, and in most cases, the spraying time of the apparatuses cannot be controlled intentionally and it is difficult to meet the technical requirement that the spraying time should be less than 120 s.

SUMMARY

In order to solve the above-mentioned problems in the prior art, an object of the present invention is to provide a bi-directional horizontal spraying aerosol fire-extinguishing apparatus, which can reduce spraying time and improve fire-suppression efficiency, free from the influence of the design solution of the fire-extinguishing agent.

The technical solution of the present invention will be described in the following: This bi-directional horizontal spraying aerosol fire-extinguishing apparatus of the invention, comprising a shell structure, an aerosol generator containing an aerosol generating agent and disposed inside the shell structure, and a control unit configured for actuating the aerosol generator, is characterized in that, both ends of the shell structure or of the aerosol generator are provided with an aerosol exhaust passage respectively.

The control unit described above may comprise an electric connector and an electric actuating device connected with the electric connector. And a combustion orifice may be provided in the center of the aerosol generating agent. The electric actuating device is disposed in the combustion orifice.

The aerosol generator may further comprise assistant devices disposed outwardly from both ends of the aerosol generating agent. The assistant devices on each end of the aerosol generator may comprise at least one of a combustion chamber, a flame-eliminating chamber and a cooling chamber.

With the apparatus according to the invention, single-point ignition and bi-directional simultaneous combustion and spraying can be achieved, thereby reducing the spraying time of the aerosol fire-extinguishing agent without reduction in fire-suppression efficiency.

Advantageously, the shell structure comprises an inner cylinder and an outer cylinder. Thermal insulation material is filled between the two cylinders. Therefore, the temperature of the outer wall of the fire-extinguishing apparatus will not be over high.

The present bi-directional horizontal spraying aerosol fire-extinguishing apparatus can be installed on walls, ceilings or under anti-static electricity floors by mounting brackets. Furthermore, a cover with an exhaust perforated plate may be provided at both ends of the outer and inner cylinders respectively. And a flue tube may be provided on the outer surface of the cover for directing the aerosol smoke, thus ensuring spraying aerosol bi-directionally without occupying useful space. Therefore the arrangement makes it possible to install the apparatus in a simple and safe way.

Preferably, 4-10 blocking plates are provided in the cooling chamber located in the inner cylinder, ensuring that during the spraying of aerosol, the aerosol is sprayed smoothly without any coolant being carried and sprayed out of the cooling chamber.

Preferably, the outer cylinder is 250-400 mm in diameter and 700-1000 mm in length, and the inner cylinder is 180-300 mm in diameter and 650-950 mm in length. The diameter of the central combustion orifice of the cylindrical aerosol generating agent is 25-110 mm, which makes it possible that the charge capacity of the apparatus increases with the spraying time of the aerosol fire-extinguishing agent being less than 120 s, thereby generally improves the capacity efficiency.

Since the apparatus according to the present invention is characterized in the structure improvement, different fire-extinguishing agents with different compositions can be applied thereto, and the spraying time of the aerosol fire-extinguishing agent can be reduced as well.

Figures 1, 2:
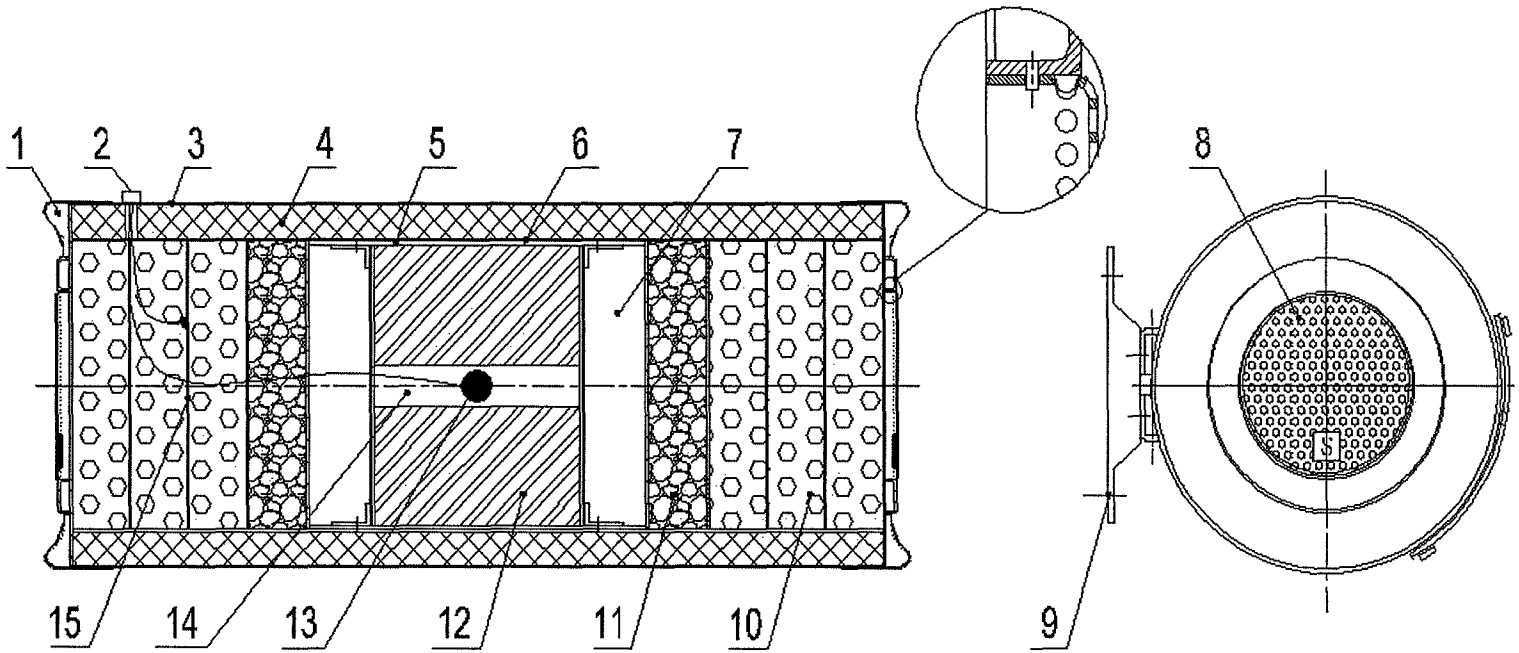
FIG. 1 shows a section view of the bi-directional horizontal spraying aerosol fire-extinguishing apparatus according to the present invention.
FIG. 2 is the left side view of the apparatus shown in FIG. 1.

Wherein, 1 refers to cover, 2 electric connector, 3 outer cylinder, 4 thermal insulation material, 5 aerosol generator, 6 inner cylinder, 7 combustion chamber, 8 gas exhaust perforated plate, 9 mounting bracket, 10 cooling chamber, 11 flame-eliminating chamber, 12 cylindrical aerosol generating agent, 13 electric actuating device, 14 combustion orifice, 15 blocking plate

DETAILED DESCRIPTION

In the following description, the present invention will be further elucidated with reference to the appended drawings.

The present bi-directional horizontal spraying aerosol fire-extinguishing apparatus comprises an aerosol generator and an aerosol generating agent, an actuating device, a cooling device, a feedback unit and a shell structure. The feedback unit used herein refers to a control unit known by the skilled person in the art. As shown in FIG. 1, the said shell structure may be cylindrical, comprising an outer cylinder 3 and an inner cylinder 6. Thermal insulation material 4 is filled in the space between the outer cylinder 3 and the inner cylinder 6. Both ends of the outer cylinder 3 and the inner cylinder 6 are all as open exhaust passages and can be respectively provided with a cover 1 having an exhaust perforated plate 8 as shown in FIG. 2. The outer surface of the cover may be provided with a flue tube, such as a serpentine pipe. The said aerosol generator 5 is disposed inside the inner cylinder 6 and contains a cylindrical aerosol generating agent 12. The diameter of the outer cylinder 3 is 250-400 mm and its length is 700-1000 mm. The diameter of the inner cylinder 6 is 180-300 mm and its length is 650-950 mm. The diameter of the central combustion orifice 14 of the cylindrical aerosol generating agent 12 is 25-110 mm. An electric actuating device 13, which is connected with the electric connector 2 through wires, is provided in the middle of the combustion orifice in the radial direction. Further assistant devices, including a combustion chamber 7, a flame-extinguishing chamber 11 and a cooling chamber 10, may be disposed symmetrically with respect to the cylindrical aerosol generating agent 12 and outwardly from both ends of the cylindrical aerosol generating agent 12. The flame-extinguishing chamber 11 and the cooling chamber 10 are respectively filled with flame-extinguishing agent and coolant. The entire fire-extinguishing apparatus is installed via a mounting bracket 9. Blocking plates 15 may be provided in the cooling chamber located inside the inner cylinder 6. The number of the blocking plates is preferably 4-10. Narrow slots may be provided in the form of sieve mesh and distributed on the blocking plate, so as to ensure the spraying of aerosol smoke and meanwhile blocking part of the coolant carried by the aerosol smoke.

Referring to FIGS. 1 and 2, the operation process of the apparatus according to the present invention is as follows: when fire arises, the electric actuating device 13 receives the impulse electricity actuation signal input from a gas fire-extinguishing controller to the present apparatus. Then the aerosol generating agent 12 is ignited. And oxidation-reduction reaction happens rapidly to the aerosol generating agent 12 itself. Via the space and oxygen provided by the combustion orifice 14 and the combustion chamber 7, the combustion spreads from center toward both sides synchronously. Via the flame-eliminating agent in the flame-eliminating chamber 11 and the heat-absorbing reaction of the chemical substance produced thereof, as well as the cooling effect of the coolant in the cooling chamber 10, the fire-extinguishing aerosol is agglomerated and then sprayed from both ends of the apparatus, achieving the object of quenching fire. In each case of experiments, large dosage of aerosol generating agent such as 9 Kg is charged into each apparatus, the average spraying time of the fire-extinguishing aerosol turns out to be less than 110 s, and three dimensional aerosol by total flooding can suspend in the protection space as long as 60 minutes, which means the object of the present invention is achieved.

The invention claimed is:

1. A bi-directional horizontal spraying aerosol fire-extinguishing apparatus, comprising a shell structure, an aerosol generator (5) including a cylindrical aerosol generating agent (12) and disposed inside the shell structure, and a control unit configured for actuating the aerosol generator (5), wherein the shell structure is cylindrical, comprising an outer cylinder (3) and an inner cylinder (6), and thermal insulation material (4) is filled in the space between the outer cylinder (3) and the inner cylinder (6), and both ends of the outer cylinder (3) and the inner cylinder (6) serve as open aerosol exhaust passages; a combustion orifice (14) is provided in the center of the aerosol generating agent (12); the said control unit comprises an electric actuating device (13) disposed in the middle of the combustion orifice (14) in the radial direction and an electric connector (2) connected with the electric actuating device (13) via wires; the aerosol generator (5) further comprises a combustion chamber (7), a flame-eliminating chamber (11) and a cooling chamber (10), which are in turn provided outwardly from either end of the aerosol generating agent (12), the flame-eliminating chamber (11) and the cooling chamber (10) are respectively filled with flame-eliminating agent and coolant; wherein the apparatus is installed via a mounting bracket (9), and wherein 4-10 blocking plates (15) are provided in the cooling chamber located in the inner cylinder (6).

2. A bi-directional horizontal spraying aerosol fire-extinguishing apparatus according to claim 1, wherein a cover (1) with an exhaust perforated plate (8) is provided at the open aerosol exhaust passage at either end of the said outer cylinder (3) and the inner cylinder (6), and the outer surface of said cover (1) is provided with a flue tube.

3. A bi-directional horizontal spraying aerosol fire-extinguishing apparatus according to claim 1, wherein the diameter of the outer cylinder (3) is 250-400 mm and its length is 700-1000 mm; the diameter of the inner cylinder (6) is 180-300 mm and its length is 650-950 mm; and the diameter of the central combustion orifice (14) of the aerosol generating agent (12) is 25-110 mm.

* * * * *